US007213783B1

(12) United States Patent
Schmatz

(10) Patent No.: US 7,213,783 B1
(45) Date of Patent: May 8, 2007

(54) TOILET PAPER HOLDER REMOVAL SYSTEM AND METHOD

(76) Inventor: John M. Schmatz, 13765 Ranch Ave. SE., Hutchinson, MN (US) 55350

( * ) Notice: Subject to any disclaimer, the term of this patent is extended or adjusted under 35 U.S.C. 154(b) by 0 days.

(21) Appl. No.: 11/294,110

(22) Filed: Dec. 6, 2005

(51) Int. Cl.
*B65H 75/18* (2006.01)

(52) U.S. Cl. ..... 242/598.3; 242/599.1

(58) Field of Classification Search ..... 242/598.2, 242/598.3, 598.6, 599.1, 599.3, 5
See application file for complete search history.

(56) References Cited

U.S. PATENT DOCUMENTS

| | | | | |
|---|---|---|---|---|
| 1,045,311 | A * | 11/1912 | Moberg | 242/599.1 |
| 1,258,313 | A | 3/1918 | Sturgis | |
| 1,665,739 | A | 4/1928 | Hoegger | |
| 2,253,664 | A * | 8/1941 | Vigo | 242/599.1 |
| 2,313,776 | A * | 3/1943 | Segal | 242/599.3 |
| 2,434,556 | A * | 1/1948 | Foltis | 242/599.3 |
| 2,522,109 | A * | 9/1950 | Foltis | 242/599.3 |
| 3,037,718 | A | 6/1962 | Pettit | |
| 3,239,158 | A * | 3/1966 | Levesque | 242/599.1 |
| 3,392,928 | A * | 7/1968 | Peterson | 242/598.4 |
| D296,963 | S | 8/1988 | Smallwood | |
| 6,092,760 | A | 7/2000 | Hedrick | |
| 6,412,726 | B2 | 7/2002 | Inana et al. | |
| 6,431,493 | B1 * | 8/2002 | Stauner | 242/598.3 |
| 6,572,051 | B1 * | 6/2003 | Stude | 242/598.2 |

* cited by examiner

*Primary Examiner*—William A. Rivera

(57) ABSTRACT

A toilet paper holder removal system includes a toilet paper holder configured for holding a toilet paper roll and dispensing toilet paper from the toilet paper roll. The toilet paper holder includes a pair of brackets each having a well extending therein. A cylinder has a first end and a second end and includes a first portion slidably extendable into a second portion. The first end is biased away from the second end. Each of a pair of nubs is attached to and extends outwardly away from one of the first and second ends. Each of the nubs is removably extended into one of the wells. A pair of grips is provided and each is configured to be removably positioned on one of the nubs. The grips may be used to provide leverage when the first end of the cylinder is urged toward the second end of the cylinder.

6 Claims, 3 Drawing Sheets

TOILET PAPER HOLDER REMOVAL SYSTEM AND METHOD

BACKGROUND OF THE INVENTION

1. Field of the Invention

The present invention relates to toilet paper holder removal devices and more particularly pertains to a new toilet paper holder removal device for assisting someone in removing a cylinder from a pair of brackets so that the leverage may more easily be exerted on the cylinder.

2. Description of the Prior Art

The use of toilet paper holder removal devices is known in the prior art. U.S. Pat. No. 3,037,718 describes a device for assisting a person in removing a toilet paper holder from its mounting. Another type of toilet paper holder removal device is U.S. Pat. No. 6,412,726 having a means for inserting and removing a roll of toilet paper from a toilet paper housing. Still another such device is found in U.S. Pat. No. 1,259,313.

While these devices fulfill their respective, particular objectives and requirements, the need remains for a device that may be easily retrofitted to existing toilet paper holders to add a person in mounting or removing a toilet paper roll from mounting brackets.

SUMMARY OF THE INVENTION

The present invention meets the needs presented above by generally comprising a toilet paper holder configured for holding a toilet paper roll and dispensing toilet paper from the toilet paper roll. The toilet paper holder includes a pair of brackets spaced from each other. The brackets each have a well extending therein. The wells face each other and are axially aligned with each other. A cylinder has a first end and a second end and includes a first portion slidably extendable into a second portion. A distance between the first and second ends may be selectively altered. The first end is biased away from the second end. Each of a pair of nubs is attached to and extends outwardly away from one of the first and second ends. Each of the nubs is removably extended into one of the wells and mounts the cylinder to the brackets. A pair of grips is provided and each is configured to be removably positioned on one of the nubs. The grips may be used to provide leverage when the first end of the cylinder is urged toward the second end of the cylinder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
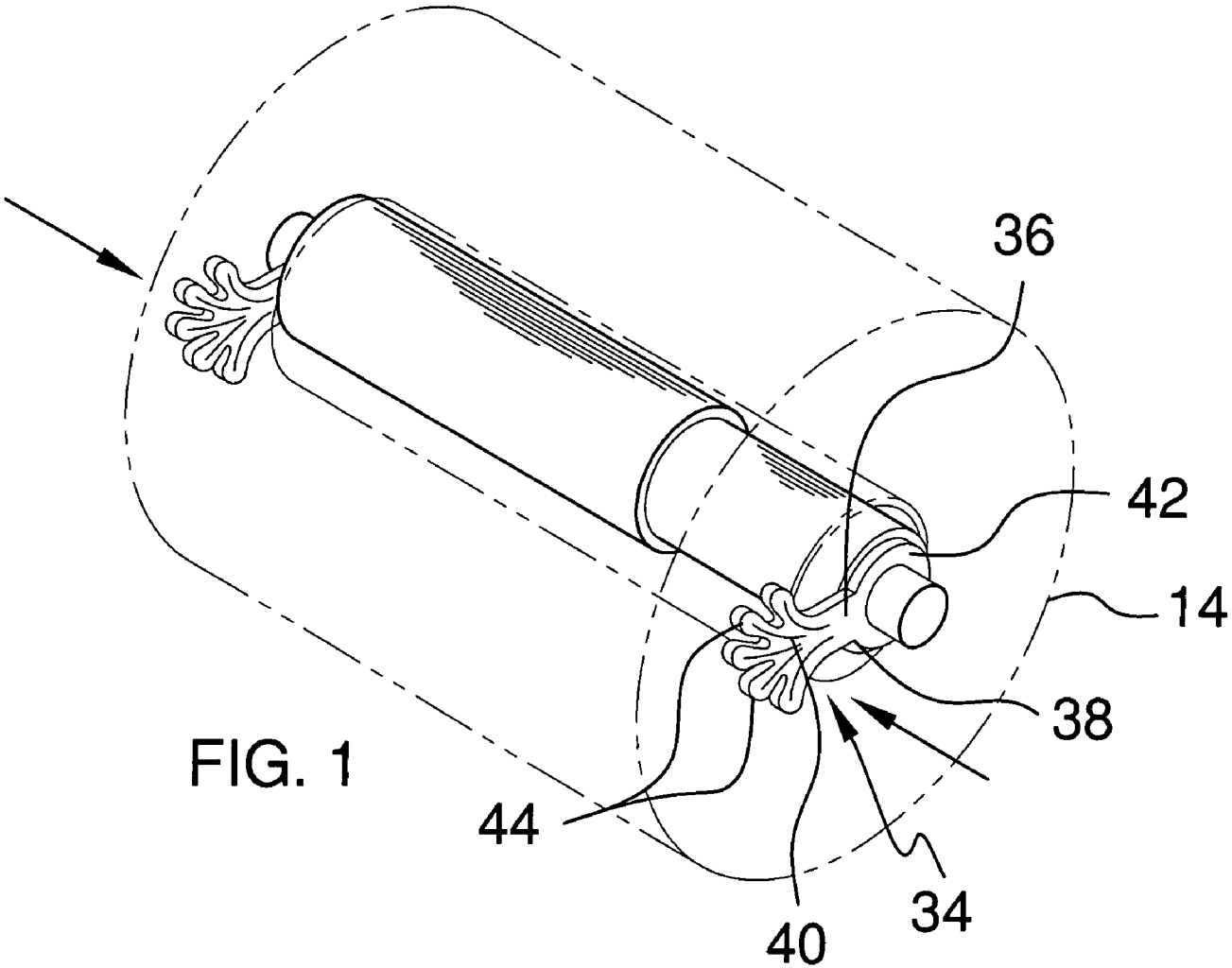
FIG. 1 is a perspective view of a toilet paper holder removal system and method according to the present invention.
Figure 2:
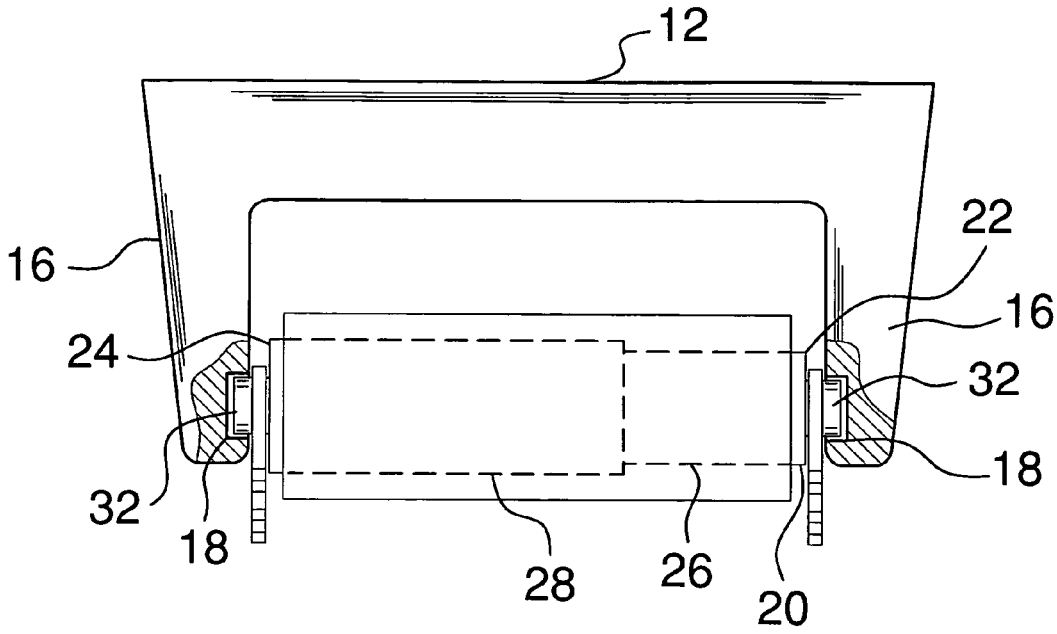
FIG. 2 is a top view of the present invention.
Figure 3:
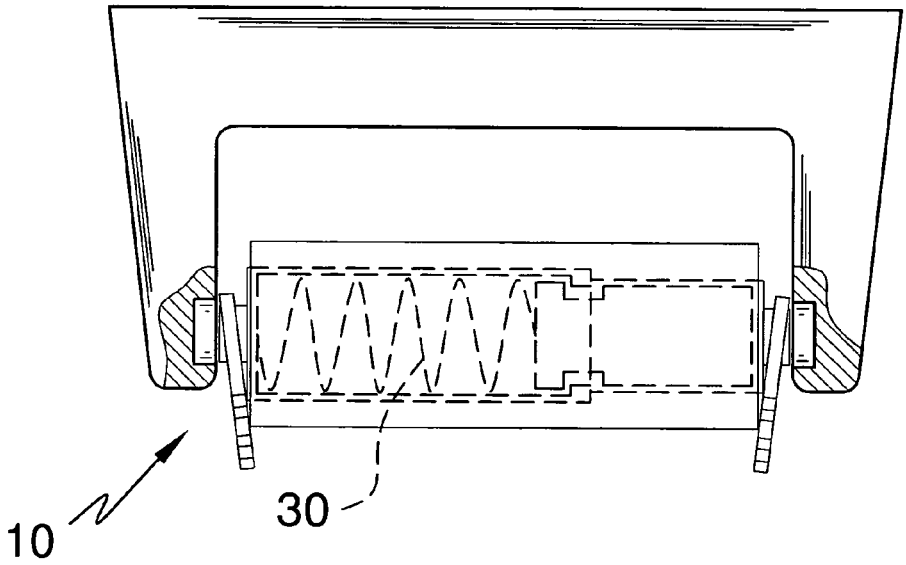
FIG. 3 is a top view of the present invention.
Figure 4:
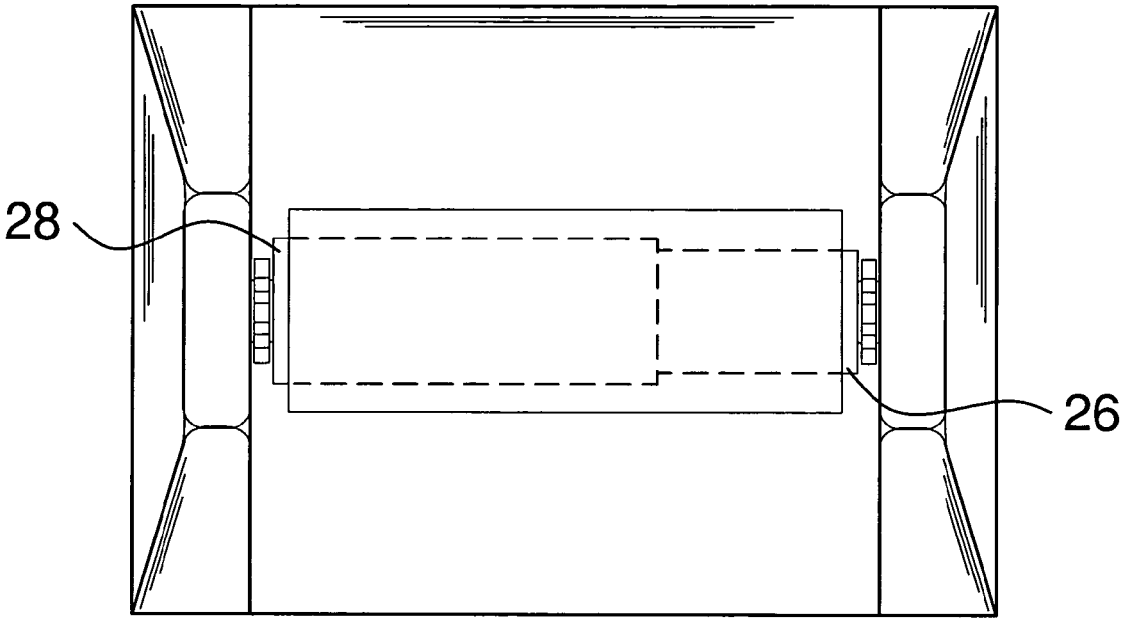
FIG. 4 is a front view of the present invention.

With reference now to the drawings, and in particular to FIGS. 1 through 4 thereof, a new toilet paper holder removal device embodying the principles and concepts of the present invention and generally designated by the reference numeral 10 will be described.

As best illustrated in FIGS. 1 through 4, the toilet paper holder removal system and method 10 generally includes a toilet paper holder 12 configured for holding a toilet paper roll 14 and dispensing toilet paper from the toilet paper roll 14. The toilet paper holder 12 includes a pair of brackets 16. The brackets 16 are spaced from each other. The brackets 16 each have a well 18 extending therein. The wells 18 face each other and are axially aligned with each other. A cylinder 20 has a first end 22 and a second end 24. The cylinder 20 includes a first portion 26 slidably extendable into a second portion 28. A distance between the first 22 and second 24 ends may be selectively altered. The first end 22 is biased away from the second end 24 by a spring 30. A pair of nubs 32 is provided and each is attached to and extends outwardly away from one of the first 22 and second 24 ends. Each of the nubs 32 is removably extended into one of the wells 18 to mount the cylinder 20 to the brackets 16. In general, the toilet paper holder 12 is conventional in structure and function.

A pair of grips is provided 34. Each of the grips 34 is configured to be removably positioned on one of the nubs 32 and configured to provide leverage when the first end 22 of the cylinder 20 is urged toward the second end 24 of the cylinder 20. Each of the grips 34 includes a panel 36 having a first end 38 and a second end 40. Each of a pair of loops 42 is attached to one of the first ends 38 of the pair grips 34. The loops 42 each lie in plane of an associated one of the panels 36. Each of the nubs 32 is extended through one of the loops 42 so that each of the grips 34 is mounted on the cylinder 20. The panels 36 may be used to urge the first 22 and second 24 ends of the cylinder 20 toward each other when the nubs 32 are is positioned in or removed from the wells 18. Each of the panels 36 has a length generally between 1 inch and 2 inches. Each of the second ends 40 of the panels 36 flares outwardly and includes a plurality of fingers 44.

In use, the grips 34 are positioned on the cylinder 20 after a roll of toilet paper 14 is placed on the cylinder 20. The grips 34 allow a person to push the ends of the cylinder 20 inwardly without interference from the brackets so that the nubs 32 may be removed from the brackets 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet paper holder removal system comprising:

a toilet paper holder configured for holding a toilet paper roll and dispensing toilet paper from the toilet paper roll, said toilet paper holder including;

a pair of brackets, said brackets being spaced from each other, said brackets each having a well extending therein, said wells facing each other and being axially aligned with each other;

a cylinder having a first end and a second end, said cylinder including a first portion slidably extendable into a second portion, wherein a distance between said first and second ends may be selectively altered, said first end being biased away from said second end;

a pair of nubs, each of said nubs being attached to and extending outwardly away from one of said first and second ends, each of said nubs being removably extended into one of said wells and mounting said cylinder to said brackets;

a pair of grips, each of said grips being configured to be removably positioned on one of said nubs and configured to provide leverage when said first end of said cylinder is urged toward said second end of said cylinder, each of said grips includes a panel having a first end and a second end, each of a pair of loops being attached to one of said first ends of said pair grips, each of said nubs being extended through one of said loops such that each of said grips is mounted on said cylinder, wherein said panels may be used to urge said first and second ends of said cylinder toward each other when said nubs are being positioned in or removed from said wells, each of said loops lying in plane of an associated one of said panels.

2. The system according to claim 1, wherein each of said panels has a length generally between 1 inch and 2 inches.

3. The system according to claim 1, wherein each of said second ends of said panels flares outwardly and includes a plurality of fingers.

4. A toilet paper holder removal system comprising:

a toilet paper holder configured for holding a toilet paper roll and dispensing toilet paper from the toilet paper roll, said toilet paper holder including;

a pair of brackets, said brackets being spaced from each other, said brackets each having a well extending therein, said wells facing each other and being axially aligned with each other;

a cylinder having a first end and a second end, said cylinder including a first portion slidably extendable into a second portion, wherein a distance between said first and second ends may be selectively altered, said first end being biased away from said second end;

a pair of nubs, each of said nubs being attached to and extending outwardly away from one of said first and second ends, each of said nubs being removably extended into one of said wells and mounting said cylinder to said brackets;

a pair of grips, each of said grips being configured to be removably positioned on one of said nubs and configured to provide leverage when said first end of said cylinder is urged toward said second end of said cylinder, each of said grips including a panel having a first end and a second end, each of a pair of loops being attached to one of said first ends of said pair grips, said loops each lying in plane of an associated one of said panels, each of said nubs being extended through one of said loops such that each of said grips is mounted on said cylinder, wherein said panels may be used to urge said first and second ends of said cylinder toward each other when said nubs are being positioned in or removed from said wells, each of said panels having a length generally between 1 inch and 2 inches, each of said second ends of said panels flaring outwardly and including a plurality of fingers.

5. A method of removing a toilet paper holder comprising the steps of:

providing a toilet paper holder configured for holding a toilet paper roll and dispensing toilet paper from the toilet paper roll, said toilet paper holder including;

a pair of brackets, said brackets being spaced from each other, said brackets each having a well extending therein, said wells facing each other and being axially aligned with each other;

a cylinder having a first end and a second end, said cylinder including a first portion slidably extendable into a second portion, wherein a distance between said first and second ends may be selectively altered, said first end being biased away from said second end;

a pair of nubs, each of said nubs being attached to and extending outwardly away from one of said first and second ends, each of said nubs being removably extended into one of said wells and mounting said cylinder to said brackets;

providing a pair of grips, each of said grips being mounted on one of said nubs, each of said grips includes a panel having a first end and a second end, each of a pair of loops being attached to one of said first ends of said pair grips, said loops each lying in plane of an associated one of said panels, each of said nubs being extended through one of said loops such that each of said grips is mounted on said cylinder; and urging said grips together and removing each of said nubs from said wells.

6. The method according to claim 5, wherein the step of providing panels each having second ends further including providing flared ones of said second ends and a plurality of fingers extending outwardly from said second ends.

* * * * *